US010662040B2

(12) United States Patent
Svoboda et al.

(10) Patent No.: US 10,662,040 B2
(45) Date of Patent: May 26, 2020

(54) ROPE GUIDANCE FOR SECOND DEVICE USED ON DURAHOIST ARM

(71) Applicant: HONEYWELL INTERNATIONAL INC., Morris Plains, NJ (US)

(72) Inventors: Radim Svoboda, Brno (CZ); Jan Hrouzek, Brno (CZ)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 16/216,355

(22) Filed: Dec. 11, 2018

(65) Prior Publication Data

US 2019/0233265 A1 Aug. 1, 2019

Related U.S. Application Data

(63) Continuation of application No. 15/443,570, filed on Feb. 27, 2017, now Pat. No. 10,183,849.

(30) Foreign Application Priority Data

Feb. 28, 2016 (EP) ..... 16157759

(51) Int. Cl.

| | |
|---|---|
| ***B66D 1/60*** | (2006.01) |
| ***B66D 1/36*** | (2006.01) |
| ***B66C 23/16*** | (2006.01) |
| ***A62B 1/10*** | (2006.01) |
| ***A62B 35/00*** | (2006.01) |

(52) U.S. Cl.

CPC ..... *B66D 1/60* (2013.01); *A62B 1/10* (2013.01); *A62B 35/0068* (2013.01); *A62B 35/0093* (2013.01); *B66C 23/166* (2013.01); *B66D 1/36* (2013.01); *B66D 2700/0116* (2013.01)

(58) Field of Classification Search

CPC .... B66D 1/36; B66D 1/60; B66D 2700/0116; A62B 1/10; A62B 35/0068; A62B 35/0093; B66C 23/166

See application file for complete search history.

(56) References Cited

U.S. PATENT DOCUMENTS 845,143 A * 2/1907 Taylor ..... B66C 23/20 212/179
1,339,263 A * 5/1920 Kernen ..... B66C 3/12 212/247
1,511,297 A * 10/1924 Pennoyer ..... B66C 23/163 212/201
2,733,817 A * 2/1956 Couse ..... B66C 13/18 212/294
3,048,371 A * 8/1962 Klimek, Jr. ..... B66D 1/12 254/362
3,591,022 A 7/1971 Polyakov et al.
4,225,117 A 9/1980 Suzuki (Continued)

OTHER PUBLICATIONS

European Search Report for Application 16157759.8 dated Aug. 9, 2016.

*Primary Examiner* — Michael E Gallion
(74) *Attorney, Agent, or Firm* — Alston & Bird LLP

(57) ABSTRACT

A line guidance device (40) is provided for use with a confined space entry/retrieval hoist and fall protection anchorage system (10) and includes a line guide (46) that guides a line from an extend/retract line device (22) past another extend/retract line device (20) with both devices (20, 22) mounted on a backside (24) of a mast (12) of the system (10).

18 Claims, 3 Drawing Sheets

(56) References Cited

U.S. PATENT DOCUMENTS 4,271,970 A * 6/1981 Miller ..... B66C 13/02 212/232
4,589,523 A 5/1986 Olson et al.
5,147,013 A * 9/1992 Olson ..... A62B 1/08 182/142
5,150,768 A * 9/1992 Olson ..... A62B 1/10 182/234
5,211,526 A * 5/1993 Robinette ..... B60P 1/5471 212/238
5,431,526 A * 7/1995 Peterson ..... B60P 1/5433 212/223
5,752,799 A * 5/1998 Carey ..... B60P 1/5471 224/403
5,791,858 A * 8/1998 Sasser ..... A22B 5/161 414/462
5,820,108 A * 10/1998 Ostrobrod ..... A62B 1/06 254/281
6,138,992 A * 10/2000 Bell ..... B66D 1/00 224/519
6,234,453 B1 * 5/2001 Block ..... B66C 23/208 212/296
6,401,863 B1 * 6/2002 Kirkland ..... B66D 3/20 182/142
6,981,834 B1 * 1/2006 Henry ..... B60P 1/5471 212/299
7,681,747 B2 * 3/2010 Crowder ..... B66C 23/22 212/166
7,699,292 B2 * 4/2010 Barnett ..... B66C 23/20 212/292
7,913,726 B1 * 3/2011 Honnell ..... B27L 7/06 144/193.1
8,910,922 B1 * 12/2014 Erickson ..... E04F 21/0007 254/281
9,073,734 B1 * 7/2015 Cates ..... B66C 23/203
9,248,999 B2 * 2/2016 Xydias ..... B66D 1/38
9,434,582 B2 * 9/2016 Arthur ..... B66C 23/00
9,802,800 B2 * 10/2017 Kalakay, Jr. ..... B66D 3/26
10,183,849 B2 * 1/2019 Svoboda ..... A62B 35/0068
2007/0248443 A1 * 10/2007 Stucks ..... A22B 5/06 414/462
2009/0095944 A1 * 4/2009 Gaines ..... B66C 23/005 254/334
2011/0127477 A1 * 6/2011 Kokolis ..... B66C 13/16 254/285
2014/0252285 A1 * 9/2014 Genoe ..... B66C 23/44 254/280

* cited by examiner

ROPE GUIDANCE FOR SECOND DEVICE USED ON DURAHOIST ARM

CROSS-REFERENCE TO RELATED APPLICATIONS

This application is a continuation of U.S. application Ser. No. 15/443,570, filed on Feb. 27, 2017, titled "Rope Guidance for Second Device Used on Durahoist Arm," which claims priority to European Application No. 16157759.8, filed on Feb. 28, 2016 titled "Rope Guidance for Second Device Used on Durahoist Arm," the entire contents of each of which are hereby incorporated by reference in their entirety.

FEDERALLY SPONSORED RESEARCH OR DEVELOPMENT

Not Applicable.

MICROFICHE/COPYRIGHT REFERENCE

Not Applicable.

FIELD

This disclosure relates to worker entry/retrieval systems for manhole and other confined space applications and to fall protection for such systems, and in more particular applications, to lightweight and portable versions of such systems.

BACKGROUND

Confined space entry/retrieval hoist and fall protection anchorage systems are known for lowering and raising a worker into and out of a confined space, such as a manhole, and for providing fall protection during the entry/retrieval and, at least in some applications, while the worker performs tasks in the confined space. Such systems typically have a mast/boom structure with two separate devices attached to the mast/boom structure for extending and retracting support lines that are attached to a worker suspended from the system, with one of the devices being a winch having a winch line supported by the mast/boom structure and connected to the worker for lowering and raising the worker into and out of the confined space, and the other device being a self-retracting lifeline (SRL) having another line supported by the mast/boom structure and attached to the worker for providing fall protection during the entry/retrieval of the worker and, at least in some instances, while the worker performs tasks in the confined space. Conventional systems mount the winch on the side of the mast/boom structure that faces away from the confined space/manhole and mount the SRL on the side of the mast/boom that faces the confined space/manhole. While conventional systems have proven suitable for their intended use, the location of the SRL on the side of the mast/boom structure facing the confined space/manhole increases the resultant load applied to the system, complicates the operation of the SRL, and increases the safety hazard because the SRL is typically mounted directly above the confined space/manhole due to the positioning of the mast/boom closely adjacent the confined space/manhole. Accordingly, there is room for improvement in a system that would address one or more of these issues.

SUMMARY

In accordance with one feature of this disclosure, a confined space hoist and fall protection anchorage system is provided for raising and lowering a worker into and out of a confined space. The system includes a longitudinally extending mast, a masthead, first and second extend/retract line devices carried on the mast and positioned on a first side of the mast. The first extend/retract line device has a first line extending from the first extend/retract line device to the masthead to connect to a worker suspended by the system. The second extend/retract line device has a second line extending from the second extend/retract line device to the masthead to connect to the worker suspended by the system. The first extend/retract line device is mounted on the mast between the second extend/retract line device and the masthead. The system further includes a line guidance device including a mast mount structure connected to the mast, and an extend/retract line device mount structure positioning the first extend/retract line device on the first side of the mast. A line guide is located on the line guidance device between the mount structures to guide the second line between the mast and the first extend/retract line device as the second line travels from and to the second extend/retract line device and the masthead as a worker suspended from the second line is lowered and raised by the system.

As one feature, the system includes a mast arm mounted on the mast adjacent an end of the mast and extending from a second side of the mast to the masthead. The second side is an opposite side of the mast from the first side.

In one feature, the line guide is a pulley mounted in the line guidance device for rotation.

According to one feature, the mast mount structure includes a pair of spaced flanges located on opposite sides of the mast and secured to the mast with a plurality of fasteners and the extend/retract line device mount structure is a plate configured to secure the first extend/retract line device with a plurality of fasteners.

As one feature, the masthead includes a pair of masthead pulleys, one of the masthead pulleys configured to guide the first line for movement as the first line travels to and from the first extend/retract line device and the other masthead pulley being configured to guide the second line for movement as the second line travels to and from the second extend/retract line device. In a further feature, one of the masthead pulleys is mounted in the masthead at a first location, the other of the masthead pulleys mounted in the masthead at a second location, with the second location being spaced further from the mast than the first location.

According to one feature, the mast extends in a vertical direction.

As one feature, the first extend/retract line device is a winch and the first line is a winch cable.

In one feature, the second extend/retract line device is a self-retracting lifeline device and the second line is a lifeline.

According to one feature, a confined space hoist and fall protection anchorage system is provided for raising and lowering a worker into and out of a confined space. The system includes a longitudinally extending mast, a masthead, first and second device mount locations on the mast and configured to mount respective first and second extend/retract line devices to the mast so that the first and second extend/retract line devices are positioned on a first side of the mast, with the first line extend/retract line device having a first line extending from the first extend/retract line device to the masthead to connect to a worker suspended by the system, and the second extend/retract line device having a second line extending from the second extend/retract line device to the masthead to connect to the worker suspended by the system. The first extend/retract line device mount location is located on the mast between the masthead and the second extend/retract line device mount location. The system further includes a line guidance device having a mast mount structure connected to the mast at the first device mount location, a device mount structure configured to position the first extend/retract line device on the first side of the mast, and a line guide located on the line guidance device between the mount structures, the line guide configured to guide the second line between the mast and the first extend/retract device as the second line travels from and to the second extend/retract line device and the masthead as a worker suspended from the second line is lowered and raised by the system with the first extend/retract device mounted on the device mount structure and the second extend/retract line device mounted at the second device mount location.

In one feature, the line guide is a pulley mounted in the line guidance device for rotation.

According to one feature, the first extend/retract line device is mounted to the device mount structure, and the second extend/retract line device is mounted at the second device mount location and positioned on the first side of the mast.

As one feature, a line guidance device for use with a confined space hoist and fall protection anchorage system is provided for raising and lowering a worker into and out of a confined space. The system includes a longitudinally extending mast, a masthead, first and second extend/retract line devices positioned on a first side of the mast, and a mast arm mounted on the mast adjacent an end of the mast and extending from a second side of the mast to the masthead. The second side is an opposite side of the mast from the first side. The first extend/retract line device has a first line extending from the first extend/retract line device to the masthead to connect to a worker suspended by the system. The second extend/retract line device has a second line extending from the second extend/retract line device to the masthead to connect to the worker suspended by the system. The first extend/retract line device is mounted on the mast between the second extend/retract line device and the masthead. In some embodiments, the line guidance device can include a first mount structure and a second mount structure. In some embodiments, the line guidance device includes a mast mount structure connectable to the mast, an extend/retract line device mount structure configured to position the first extend/retract line device on the first side of the mast, and a line guide located on the device between the mount structures to guide the second line between the mast and the first extend/retract line device as the second line travels from and to the second extend/retract line device and the masthead as a worker suspended from the second line is lowered and raised by the system.

In one feature, the line guide is a pulley mounted in the line guidance device for rotation.

According to one feature, the mast mount structure is a pair of spaced flanges located to be positioned on opposite sides of the mast and secured to the mast with a plurality of fasteners, and the extend/retract line device mount structure is a plate configured to secure the first extend/retract line device with a plurality of fasteners.

Other features and advantages will become apparent from a review of the entire specification, including the appended claims and drawings.

DETAILED DESCRIPTION

Figure 1:
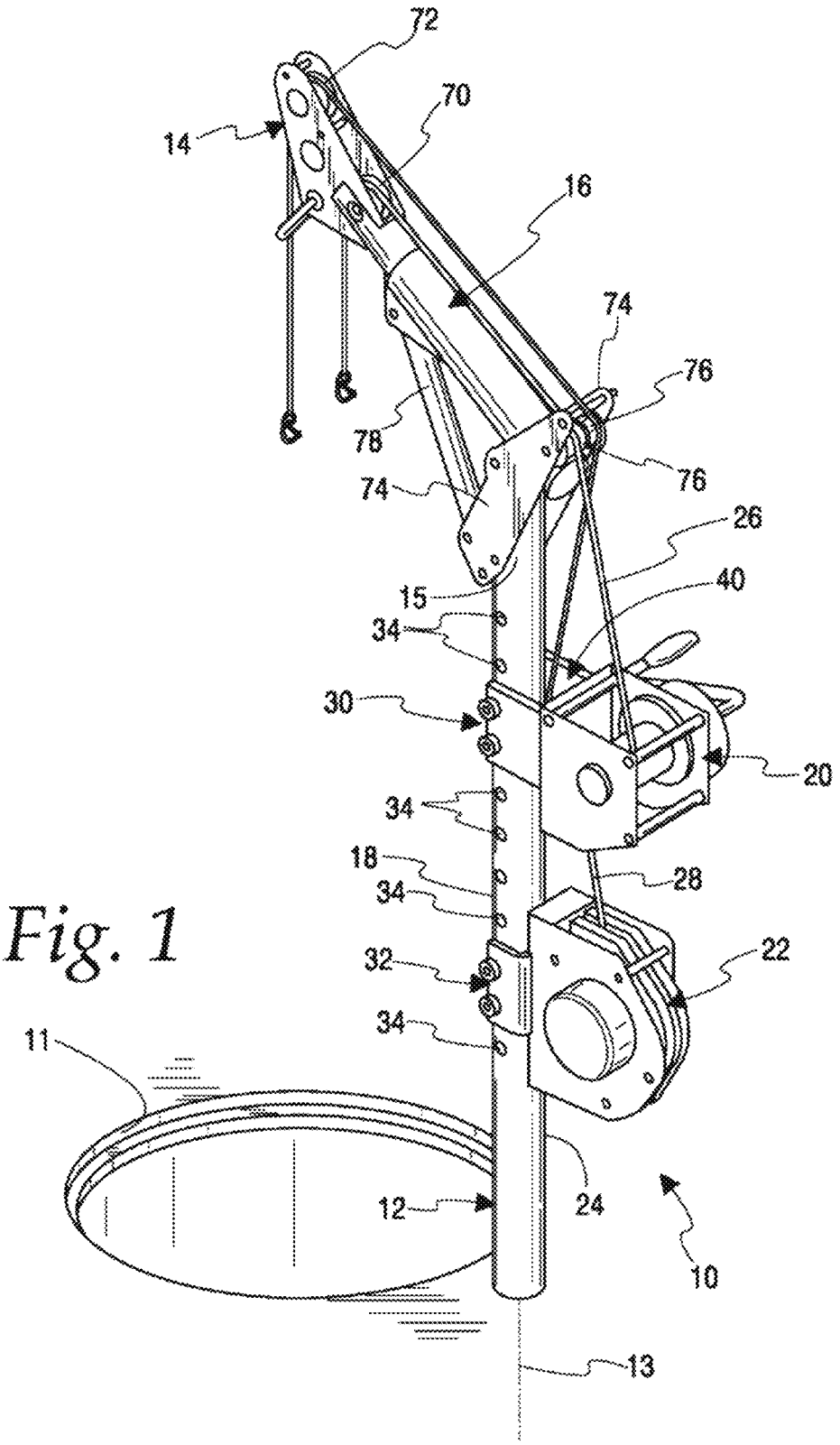
FIG. 1 is a perspective view from above and to the left of a confined space entry/retrieval system and line guidance device according to this disclosure.
Figure 2:
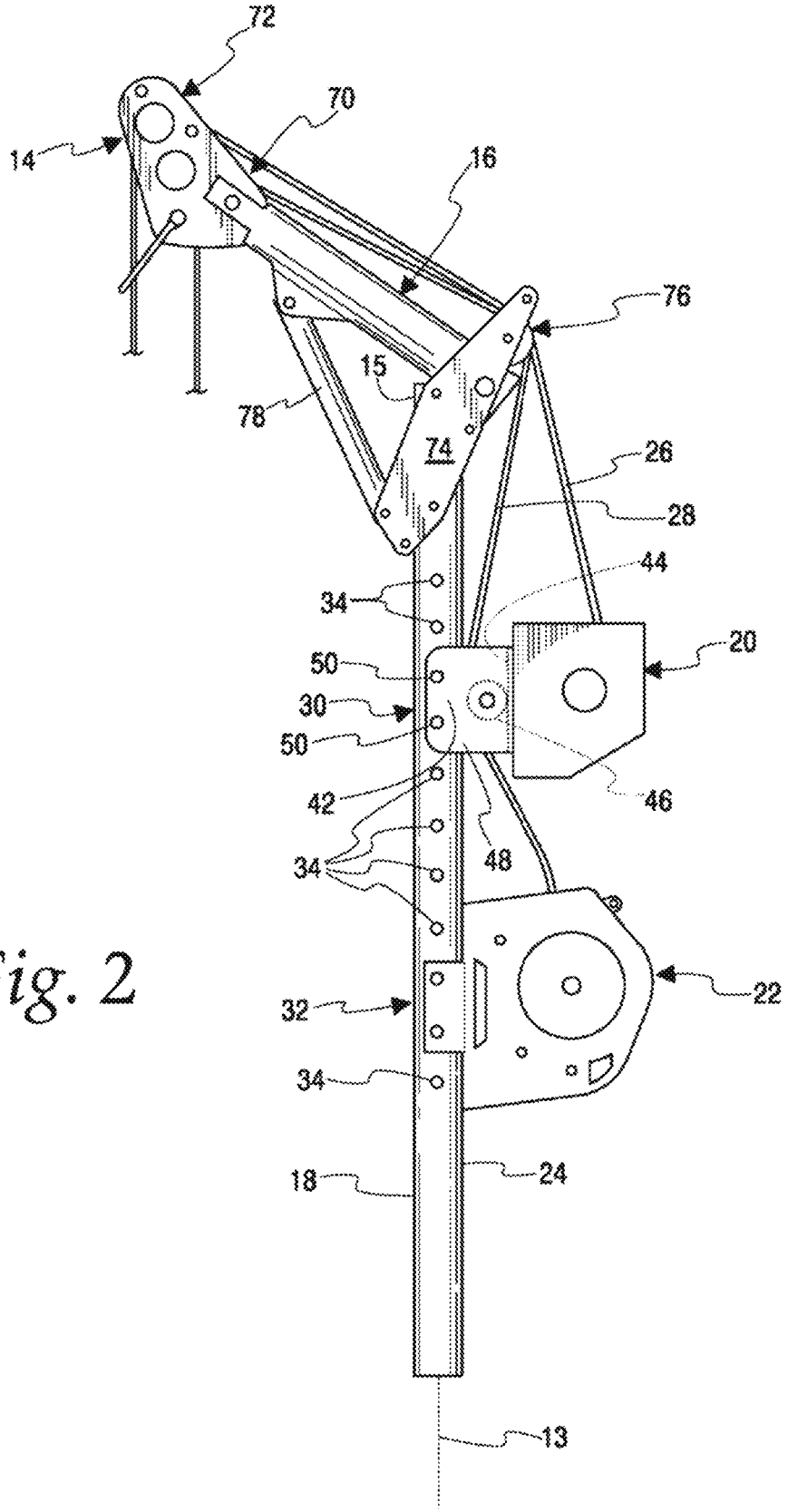
FIG. 2 is a side elevation view of the system and line guidance device of FIG. 1.

With reference to FIGS. 1 and 2, a confined space, entry and retrieval hoist and fall protection anchorage system 10 is shown for lowering and raising a worker into and out of a confined space, such as a manhole shown at 11, and for providing fall protection to the worker during entry and retrieval and while the worker performs tasks in the confined space. The illustrated system 10 includes a longitudinally extending mast 12 extending along a vertical axis 13, a masthead 14, a mast arm 16 mounted on the mast 12 adjacent an end 15 of the mast 12 and extending from a front side 18 of the mast 12 to the masthead 14 so as to extend over the confined space/manhole 11, preferably centering the masthead 14 over the confined space/manhole. The mast 12 can be referred to as "a first post" and the mast arm 16 can be referred to as "a second post" herein and in the accompanying claims. The length of the mast 12 and the length of the mast arm 16 can be adjusted, as can be the extension angle of the mast arm 14 relative to the mast 12. The general construction and assembly of the components 12, 14, and 16 are known, with commercially available examples being marketed as a family of products under the trademark "Miller DuraHoist Confined Space System" by Honeywell International Inc. Other suitable constructions for the components 12, 14 and 16 are commercially available and can be utilized according to this disclosure. Accordingly, the details of these components are not necessary for an understanding of the inventive concepts disclosed herein; however, some details will be discussed as they relate to the inventive concepts disclosed.

The system 10 further includes first and second extend/retract line devices 20 and 22 carried on the mast and positioned on a backside 24 of the mast 12. The first extend/retract line device 20 is shown in the form of a hand operated winch 20 having a line 26 extending from the winch 20 to the masthead 14 and then downward from the masthead 14 to connect to a worker suspended by the system 10. The second extend/retract line device 22 is shown in the form of an SRL 22 having a lifeline 28 extending from the SRL 22 to the masthead 14 and then downward from the masthead 14 to connect to the worker suspended by the system 10. In the illustrated embodiment, the winch 20 is mounted to a first mount location 30 on the mast 12, and the SRL 22 is mounted to a second mount location 32 on the mast 12, with the second mount location 32 being spaced further from the masthead 14 than the first mount location 30, which thereby positions the winch 20 on the mast 12 between the SRL 22 and the masthead 14. In the illustrated embodiment of the mast 12, each of the mount locations 30 and 32 are defined by a pair of fastener receiving openings 34 formed in the mast 12, with a series of equally spaced openings 34 being provided so as to allow the locations 30 and 32 to be altered according to the particular requirements of the confined space/manhole application for which the system 10 is being used. The SRL 22 can either be attached directly to the mast 12 with suitable fasteners, or via a suitable mount bracket that would carry the SRL 22 and be mounted to the mast 12 with suitable fasteners, with the details of such a mount bracket being dependent upon the particular configuration of the SRL 22 being utilized with the system 10. It should be understood that there are many known, commercially available winches and SRL's that are suitable for use with the system 10, and accordingly, the details of the winch 20 and the SRL 22 are not critical to an understanding of the inventive concepts disclosed herein.

Figure 4:
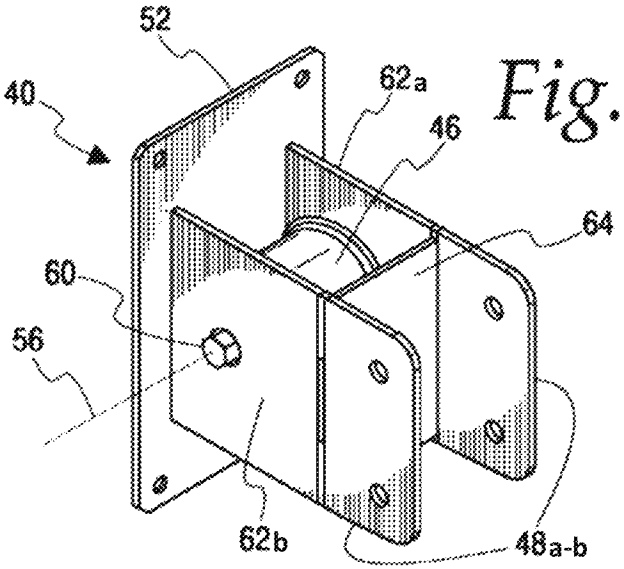
FIG. 4 is a perspective view of the line guidance device of FIGS. 1-3.
Figure 5:
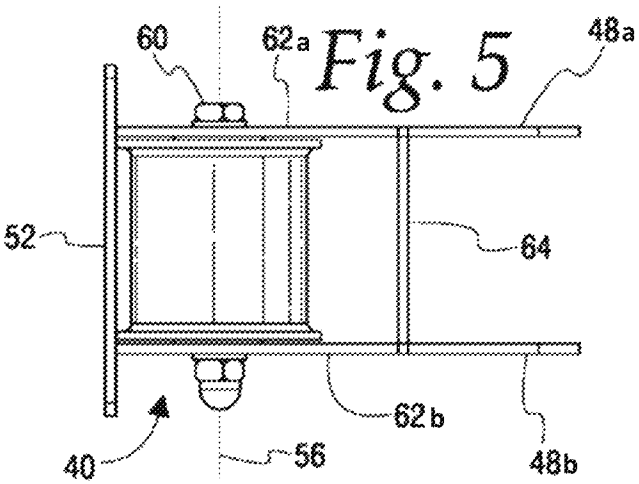
FIG. 5 is a bottom view of the line guidance device of FIGS. 1-4.

The system 10 further includes a line guidance device 40 that directs the line 28 of the SRL 22 past the winch 20 as it travels between the SRL 22 and the masthead 14. As best seen in FIG. 2, the line guidance device 40 is positioned on the backside 24 of the mast 12 and includes a mast mount structure 42 connected to the mast 12, an extend/retract line device mount structure 44 (best seen in FIGS. 3-5) mounting the winch 20 and positioning the winch 20 on the backside 24 of the mast 12, and a line guide 46 (again best seen in FIGS. 3-5) located on the line guidance device 40 between the mount structures 42 and 44 to guide the line 28 between the backside 24 of the mast 12 and the winch 20 as the line 28 travels from and to the SRL 22 and the masthead 14 as a worker suspended from the line 28 is lowered and raised by the system 10.

Figure 3:
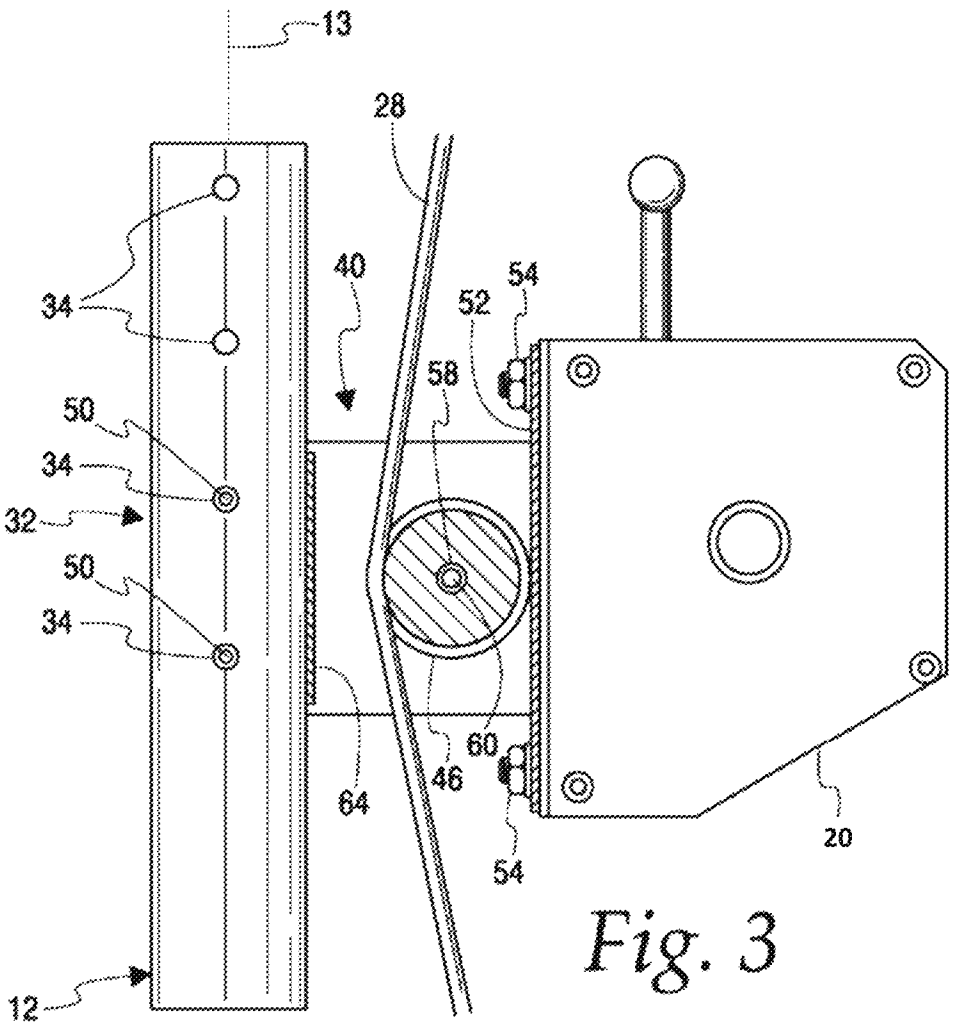
FIG. 3 is an enlarged partial section view taken from line 3-3 in FIG. 1 showing the line guidance device and a portion of the system of FIGS. 1 and 2.

In the illustrated embodiment, the mast mount structure 42 is provided in the form of a pair of spaced flanges 48*a-b* located on opposite sides of the mast 12 and secured to the mast 12 with a pair of suitable fasteners 50, such as, for example, quick release pins 50 or threaded fasteners 50. As best seen in FIG. 3, the extend/retract line device mount structure 44 in the illustrated embodiment is provided in the form of a plate 52 configured to secure the winch 20 with a plurality of suitable fasteners 54, such as a plurality of threaded fasteners 54. The line guide 46 is provided in the form of a pulley 46 mounted in the illustrated embodiment in the line guidance device 40 for rotation about an axis 56 that extends perpendicular to the vertical axis 13 of the mast 12, with a journal axle 58 (best seen in FIG. 3) surrounding a suitable threaded fastener 60 that extends between a pair of structural support flanges 62*a-b* of the device 40. The pulley 46 is positioned between the plate 52 and a structural support plate 64 fixed to the flanges 48*a-b* and 62*a-b* to provide structural support to the flanges 48*a-b* and 62*a-b*. In the illustrated embodiment, a first flange 62*a* and second flange 62*b* can be positioned a distance apart and fixed to the structural support plate 64 and/or the plate 52, with the pulley 46 disposed therebetween. In the illustrated embodiment, a single piece of metal or other suitable material defines the flanges 48*a-b* and 62*a-b* on each side of the device 40. It should be understood that the illustrated construction of the device 40 provides a simple, low part count, assembly, but that other configurations may be desirable depending upon the requirements of each particular application and the construction of the particular extend/retract line device being mounted by the device 40 and the specific type of line being guided by the line guide 46. For example, the extend/retract line device mount structure 44 can be provided in other forms then the plate 52, depending upon the construction of the particular winch 20 or other particular type of extent/retract device line device 20 utilized for a particular application. As another example, other types of structural supports could be utilized to replace the support plate 64. As yet a further example, depending upon the specifics of the mast 12 utilized in the system 10 for a particular application, something other than a pair of spaced flanges 48*a-b* connected with suitable fasteners may be desirable.

In the illustrated embodiment, the masthead 14 includes a pair of pulleys 70 and 72, with the pulley 70 guiding the line 26 and the pulley 72 guiding the line 28. In this regard, the pulley 72 is positioned further from the mast 12 than the pulley 70 so as to provide horizontal separation between the lines 26 and 28 which allows for easier and better attachment of the lines 26 and 28 to a worker suspended from the system 10 and reduces the possibility of the lines 26 and 28 becoming tangled. It should be appreciated that depending upon the requirements of any particular application the pulley 70 could be utilized to guide the line 28 and the pulley 72 could be utilized to guide the line 26. Also in the illustrated embodiment, the mast arm 16 is mounted to the mast 12 by pair of brackets 74 located on opposite sides of the mast 12 and further supporting a pair of pulleys 76 that guide the lines 26 and 28 from the devices 20 and 22 to the pulleys 70 and 72, with each of the pulleys 76 guiding a respective one of the lines 26 and 28. The illustrated embodiment also includes a link or spar 78 having an adjustable longitudinal length extending from the mast arm 16 to the brackets 74 to adjust the angular position of the mast arm 16 relative to the mast 12. Additionally, the spar 78 can be referred to as "an arm" or "a longitudinally extending arm" herein and in the claims. Additionally, though not shown, the system 10 can further include a base configured to structurally support the mast 12 and the remainder of the system 10 on a surface surrounding the confined space/manhole 11, many suitable types of which are known.

It should be understood that as used herein, the term "line" is intended as a broad term that can include any type of cable, rope, webbing, and/or other line utilized in a winch and/or SRL. It should also be understood that as used herein, the term "mast" is intended as a broad term that includes any type of boom, beam, mast, or other main structural support for a confined space entry/retrieval hoist and fall protection anchorage system.

It should be understood that while a specific embodiment of the system 10 has been shown herein, the disclosure contemplates other possible embodiments, several examples of which have already been provided. As a further example, while the illustrated embodiment shows the winch 20 being mounted by the line guidance device 40 at the first location 30 and the SRL 22 to be mounted at the second location 32, in some embodiments it may be desirable for the SRL 22 to be mounted by the line guidance device 40 at the first location 30, with the winch 20 being mounted at the second location 32.

It will be appreciated by those skilled in the art that the line guidance device 40 allows for mounting both the winch 20 and the SRL 22 on the backside 24 of the mast 12 and that, in comparison to conventional systems that mount the winch 20 and SRL 22 on opposite sides of the mast 12, the positioning of the winch 20 and the SRL 22 on the backside 24 decreases the resultant load applied to the system 10, increases the bearing capacity of the system 10, increases comfort and ease of use during operation of the system 10, minimizes the interference of the SRL with a worker being lowered and/or raised by the system 10, and reduces the safety hazard because the SRL 22 is not mounted above the confined space/manhole.

The invention claimed is:

1. A confined space hoist and fall protection anchorage system comprising:

a post comprising a first side, a second side, a proximal end, and a distal end, the post oriented along a first axis;

a line guidance device releasably coupled to the post at a first position and oriented away from the confined space, the line guidance device comprising a first flange and a second flange, the first flange and the second flange coupled perpendicularly a distance apart on a mounting plate, a pulley mounted between the first flange and the second flange and configured to rotate about a second axis perpendicular to the first axis;

a first extend/retract line device supported on the mounting plate; and a second extend/retract line device removably coupled on the first side to the post at a second position proximal to the first position.

2. The system of claim 1, wherein the line guidance device comprises:

a first mount structure removably coupled on the first side to the post at the first position, the first extend/retract line device being coupled to the first mount structure; and a second mount structure removably coupled on the first side to the post at the second position proximal to the first position, the second extend/retract line device being coupled to the second mount structure.

3. The system of claim 1, wherein the post is a first post, the system further comprising:

a second post comprising one or more pulleys disposed at a distal end of the second post and one or more other pulleys disposed at a proximal end of the second post, the second post pivotably coupled to the first post via one or more brackets and a spar coupled to the first post and the second post, the spar having an adjustable longitudinal length such that, as the spar is extended and retracted, the second post is pivoted at the proximal end about the first post.

4. The system of claim 3, wherein the line guidance device is configured to guide a line between the second extend/retract line device and the one or more pulleys disposed at the distal end of the second post as the line travels from and to the one or more pulleys as the worker suspended from the line is lowered and raised by the system.

5. The system of claim 1, wherein the line guide comprises another pulley mounted at least partially within the line guidance device for rotation.

6. The system of claim 2, wherein each of the first mount structure and the second mount structure comprises a pair of spaced flanges configured to be positioned on opposite sides of the first post and configured to be releasably coupled to the first post using one or more fasteners.

7. The system of claim 6, wherein each of the first mount structure and the second mount structure comprises one or more plates configured to be secured to the first post with one or more other fasteners.

8. The system of claim 3, wherein the one or more pulleys comprise a first pulley and a second pulley, the first pulley being configured to guide a first line for movement as the first line travels to and from the first extend/retract line device, and the second pulley being configured to guide a second line for movement as the second line travels to and from the second extend/retract line device.

9. The system of claim 8, wherein the first pulley is coupled to the second post at a first location and the second pulley is coupled to the second post at a second location further from the first post than the first location.

10. The system of claim 3, wherein the first extend/retract line device is a winch and the first line is a winch cable.

11. The system of claim 8, wherein the second extend/retract line device is a self-retracting lifeline device and the second line is a lifeline.

12. A confined space hoist and fall protection anchorage system comprising:

a first post positioned adjacent to a confined space, the first post oriented along a vertical axis and having a first side oriented away from the confined space;

a second post comprising one or more pulleys at a proximal end of the second post and one or more other pulleys at a distal end of the second post, the second post pivotably coupled to the first post via one or more brackets and a spar coupled to the first post and the second post, the spar having an adjustable longitudinal length such that, as the spar is extended and retracted, the second post is pivoted at a proximal end about the first post;

an extend/retract line device removably coupled to the on the first side to the first post at a first position, the extend/retract line device comprising a line guidance device, the line guidance device being releasably coupled to the first post at a first position and oriented away from the confined space, the line guidance device comprising a first flange spaced a distance apart from, and oriented perpendicular to, a second flange, the first flange and the second flange being supported on a mounting bracket, the line guidance device further comprising a pulley mounted between the first flange and the second flange, the pulley configured to rotate about a second axis perpendicular to the first axis; and a second extend/retract line device removably coupled on the first side to the first post at a second position proximal the first position.

13. The system of claim 12, wherein the one or more other pulleys at the distal end of the second post comprises a first pulley and a second pulley, the first pulley being configured to guide a first line for movement as the first line travels to and from the first extend/retract line device, and the second pulley being configured to guide a second line for movement as the second line travels to and from the second extend/retract line device.

14. The system of claim 13, wherein the first pulley is positioned further from the first post than the second pulley.

15. The system of claim 13, wherein the first extend/retract line device is a winch and the first line is a winch cable.

16. The system of claim 13, wherein the second extend/retract line device is a self-retracting lifeline device and the second line is a lifeline.

17. A confined space hoist and fall protection anchorage system comprising:

a post positioned adjacent to a confined space along a first axis;

a line guidance device releasably coupled to the post at a first position and oriented away from the confined space, the line guidance device comprising a first flange and a second flange, the first flange and the second flange coupled perpendicularly a distance apart on a mounting plate, a pulley mounted between the first flange and the second flange and configured to rotate about a second axis perpendicular to the first axis;

a winch coupled to the mounting plate of the line guidance device, the winch configured to extend and retract a winch cable coupled to a harness worn by a worker suspended by the system; and a self-retracting lifeline device removably coupled to the post at a second position proximal to the first position and oriented away from the confined space, the self-retracting lifeline device configured to extend and retract a lifeline extending from the self-retracting lifeline device, about the pulley of the line guidance device, and coupled to the harness worn by the worker suspended by the system.

18. The system of claim 17, wherein the post is a first post, the system further comprising:

a second post comprising one or more pulleys disposed at a distal end of the second post and one or more other pulleys disposed at a proximal end of the second post, the second post pivotably coupled to the first post via one or more brackets and a spar coupled to the first post and the second post, the spar having an adjustable longitudinal length such that, as the spar is extended and retracted, the second post is pivoted at the proximal end about the first post.

* * * * *